US006988969B2

(12) United States Patent
Avis

(10) Patent No.: US 6,988,969 B2
(45) Date of Patent: Jan. 24, 2006

(54) GAME BALL WITH BRIDGED PANELS

(75) Inventor: Richard Avis, Tigard, OR (US)

(73) Assignee: Nike, Inc., Beaverton, OR (US)

( * ) Notice: Subject to any disclaimer, the term of this patent is extended or adjusted under 35 U.S.C. 154(b) by 363 days.

(21) Appl. No.: 10/128,266

(22) Filed: Apr. 24, 2002

(65) Prior Publication Data

US 2003/0203779 A1 Oct. 30, 2003

(51) Int. Cl.
*A63B 41/08* (2006.01)

(52) U.S. Cl. ..... 473/599; 473/604

(58) Field of Classification Search ..... 473/598, 473/599, 604, 605, 596, 597, 607, 603, 609; 40/327; D21/707, 713
See application file for complete search history.

(56) References Cited

U.S. PATENT DOCUMENTS

| | | | | |
|---|---|---|---|---|
| 1,890,566 | A * | 12/1932 | Bartky | 473/599 |
| 3,199,871 | A | 8/1965 | Dom | |
| D263,491 | S | 3/1982 | Surridge | |
| 4,318,544 | A | 3/1982 | Brine, Jr. | |
| D268,853 | S | 5/1983 | Brine, Jr. | |
| D270,851 | S | 10/1983 | Feger | |
| 4,542,902 | A | 9/1985 | Massino | |
| 4,620,842 | A | 11/1986 | Wang | |
| D290,632 | S | 6/1987 | Dehnert et al. | |
| D299,845 | S | 2/1989 | Gray | |
| D299,940 | S | 2/1989 | Fitzgerald et al. | |
| 4,830,373 | A | 5/1989 | Dehnert et al. | |
| D306,469 | S | 3/1990 | Norman et al. | |
| D306,470 | S | 3/1990 | Norman et al. | |
| D330,239 | S | 10/1992 | Obermann | |
| 5,236,196 | A | 8/1993 | Blankenburg et al. | |
| 5,286,020 | A | 2/1994 | Caruso | |
| 5,580,049 | A | 12/1996 | Brantley | |
| 5,674,149 | A | 10/1997 | Schaper et al. | |
| 5,709,623 | A | 1/1998 | Schwaner | |
| D405,486 | S | 2/1999 | Chan | |
| D408,877 | S | 4/1999 | Sonntag et al. | |
| D416,961 | S | 11/1999 | Sonntag et al. | |
| 6,220,979 | B1 | 4/2001 | Chan | |
| 6,302,815 | B1 * | 10/2001 | Shishido et al. | 473/604 |
| D473,275 | S * | 4/2003 | Gundra | D21/713 |

FOREIGN PATENT DOCUMENTS

| | | |
|---|---|---|
| BE | 446898 | 8/1942 |
| DE | 805 816 | 7/1949 |
| DE | 25 41 889 | 3/1977 |
| EP | 0 383 714 A1 | 2/1990 |
| FR | 1.088.671 | 3/1955 |
| FR | 2 596 182 | 3/1986 |

(Continued)

OTHER PUBLICATIONS

Database WPI, Section PQ, Week 199910, Derwent Publications, Ltd., XP-002246766.

(Continued)

*Primary Examiner*—Steven Wong
(74) *Attorney, Agent, or Firm*—Banner & Witcoff, Ltd.

(57) ABSTRACT

The invention is a game ball comprising a plurality of panels that are connected along abutting edges. The panels include at least one bridged panel that is formed of two integrally-connected, non-equilateral hexagonal portions. In addition to the bridged panels, the game ball includes equilateral pentagonal panels and non-equilateral hexagonal panels. Each hexagonal portion and each hexagonal panel includes three long edges and three short edges. A ratio of a length of each short edge to a length of each long edge is at least 0.069.

35 Claims, 5 Drawing Sheets

FOREIGN PATENT DOCUMENTS

| | | |
|---|---|---|
| FR | DES. 891974 | 2/1990 |
| FR | 1.103.710 | 11/1995 |
| GB | 2 008 836 A | 6/1979 |
| GB | 2 201 281 A | 2/1988 |
| JP | 7080097 | 3/1995 |
| NE | 1006300 | 12/1998 |
| NL | 8001207 | 2/1980 |
| SU | 1378869 A1 | 7/1988 |
| WO | WO 9303469 | 2/1993 |
| WO | WO 94 03239 | 2/1994 |
| WO | WO 01 83047 | 11/2001 |

OTHER PUBLICATIONS

International Search Report for App. No. PCT/US03/12355, mailed Jul. 24, 2003.

* cited by examiner

GAME BALL WITH BRIDGED PANELS

BACKGROUND OF THE INVENTION

1. Field of the Invention

The present invention relates to a configuration of a game ball. The invention concerns, more particularly, a game ball that includes bridged, non-equilateral, hexagonal panels.

2. Description of Background Art

The soccer ball, also referred to as a football or foosball, is the primary piece of equipment used in the game of soccer. The traditional soccer ball conventionally includes a paneled casing that surrounds an inflatable bladder. The casing is formed of a plurality of durable, wear-resistant panels that are stitched together along abutting edges to form a closed surface. The bladder, located on the interior of the casing, is formed of a material that is substantially impermeable to air and includes a valved opening, accessible through the casing, to facilitate inflation of the bladder. When inflated, the bladder expands and places a uniform outward pressure on the casing, thereby inducing the casing to take a substantially spherical shape, but not a perfectly spherical shape. Some traditional soccer balls may include a lining between the bladder and casing to provide protection for the bladder.

In mathematical terms, the panels that form the casing of the traditional soccer ball correspond to the various faces of a regular, truncated icosahedron. An icosahedron is a polyhedron having twenty faces. The term regular, when applied to an icosahedron, denotes a configuration wherein each of the twenty faces is an equally-dimensioned, equilateral triangle. A regular icosahedron, therefore, includes twenty equilateral triangular faces and twelve vertices that are formed where points of five triangular faces meet. A regular, truncated icosahedron is a regular icosahedron, as described, wherein each of the twelve vertices are removed, thereby converting the vertices into twelve pentagonal faces and converting each triangular face into a hexagonal face. Accordingly, a regular, truncated icosahedron is a polyhedron having thirty-two faces, twelve of which are equilateral pentagons and twenty of which are equilateral hexagons, and sixty vertices formed where the points of three faces meet.

The traditional soccer ball casing, which is modeled on the regular, truncated icosahedron, therefore includes thirty-two panels composed of twenty equilateral hexagonal panels and twelve equilateral pentagonal panels. The panels are stitched together along abutting edges, the stitches being located on the interior portion of the casing. The internal pressure imparted by the bladder causes each panel of the traditional soccer ball to bow outward, thereby inducing a substantially, but not perfectly, spherical shape in the soccer ball.

U.S. Pat. No. 5,674,149 to Schaper et al., hereby incorporated by reference, describes certain limitations of the traditional soccer ball. In particular, it is noted that when the soccer ball is inflated, the hexagonal panels experience greater stresses than the pentagonal panels. In addition, the degree of stress in the seams that join two hexagonal panels with each other is greater than the degree of stress in other seams. The Schaper patent further describes the increased rate of wear brought about by the stress differences described above. In particular, the seams between the hexagonal panels wear more quickly than other seams, and the hexagonal panels themselves tend to wear more quickly than the pentagonal panels.

The Schaper patent attributes these limitations to the specific configuration of the panels that comprise the traditional soccer ball. When the bladder is inflated, the bladder contacts the hexagonal panels prior to contacting the pentagonal panels. When the bladder contacts the pentagonal panels, therefore, the bladder is already in contact with a relatively large surface area of the hexagonal panels. The disparity in the manner in which the bladder contacts the panels contributes to the stress and wear differentials described above.

In order to provide a soccer ball that overcomes the limitations of the traditional soccer ball, the Shaper patent discloses a soccer ball configuration wherein the hexagonal panels and the pentagonal panels are subjected to essentially equal material stresses and degrees of stretch and whose spherical shape is improved. More specifically, the soccer ball disclosed in the Schaper patent includes a casing with equilateral pentagonal panels, and with non-equilateral hexagonal panels. Each hexagonal panel includes, therefore, both short edges and long edges. According to the Schaper patent, the ratio of the length of the short edges to the length of the long edges is preferably 0.839. The hexagonal panels are then arranged such that the long edges abut the long edges of other hexagonal panels, while the short edges abut the edges of pentagonal panels. In addition to reducing stresses, an advantage of the configuration wherein the hexagonal panels include both short and long edges is that the spherical characteristics of the soccer ball are improved in comparison with traditional soccer balls.

The Schaper patent, in summary, advances the concept that differences in stress in seams that join the hexagonal panels, differences stress between the hexagonal and pentagonal panels, and differences in wear may be alleviated by utilizing hexagonal panels that are both equiangular and non-equilateral. A further advantage of this configuration is that the spherical shape of the soccer ball is improved, thereby reducing the number of soccer balls that are rejected during the manufacturing process because they do not meet specific tolerances regarding roundness, weight, and center of gravity. The present invention provides a soccer ball that is even more spherical than the soccer ball disclosed in the Schaper patent, thereby providing a further reduction in the number of soccer balls that are rejected during the manufacturing process.

BRIEF SUMMARY OF THE INVENTION

The present invention is a game ball, such as a soccer ball or volleyball, with a casing that includes a plurality of panels connected along abutting edges. The panels include one or more bridged panels, each of which are two integrally-formed, non-equilateral, hexagonal portions. The edges of each hexagonal portion alternate between long and short lengths. Accordingly, each hexagonal portion may include three edges having a first length and three edges having a second length, the first length being greater than the second length. That is, each hexagonal portion may have three long edges of equal length which alternate with three short edges of equal length. A short edge from one hexagonal portion is integrally-formed with a short edge from the other hexagonal portion to thereby form one of the bridged panels. This configuration provides a game ball that is more spherical than other game balls, including the traditional soccer ball.

Although the number of panels may vary within the scope of the present invention, in one embodiment the game ball includes six bridged panels, twelve pentagonal panels, and eight hexagonal panels. The pentagonal panels are equilateral and, therefore, have edges of equal length. More particularly, each edge of the pentagonal panels has a length that corresponds with the length of the long edges of the bridged panels. The hexagonal panels are non-equilateral hexagons and have dimensions similar to the hexagonal portions that form the bridged panels.

The six bridged panels may be arranged such that each bridged panel does not contact another bridged panel, but instead is surrounded by four pentagonal panels and four hexagonal panels. The pentagonal panels are formed of only long edges and abut the long edges of the bridged panels. The short edges of the hexagonal panels abut only the short edges of the bridged panels. The long edges of the hexagonal panels, therefore, abut the long edges of the pentagonal panels that are not otherwise abutting the bridged panels.

The bridged panels may be arranged such that, if the center of the inflated ball is considered to be the origin of a three dimensional axis, the individual bridged panels are located at both intersections of the x-axis with the casing, both intersections of the y-axis with the casing, and at both intersections of the z-axis with the casing. Thus, if one of the bridged panels is considered to be at the top of the ball, then the other bridged panels are located at the bottom, front, back, and edges of the ball. As noted, the pentagonal panels and hexagonal panels surround the bridged panels. Although the bridged panels do not abut each other, each of the pentagonal panels abuts two bridged panels, and each of the hexagonal panels abut three bridged panels.

In this arrangement, abutting edges of the panels are connected to each other by stitching or adhesive bonding, for example, to form the casing. In addition to the casing, the ball may have an inflatable bladder located on the interior of the casing and a liner that is positioned between the casing and the bladder.

The advantages and features of novelty that characterize the present invention are pointed out with particularity in the appended claims. To gain an improved understanding of the advantages and features of novelty that characterize the present invention, however, reference may be made to the descriptive matter and accompanying drawings that describe and illustrate various embodiments of the invention.

DETAILED DESCRIPTION OF THE INVENTION

Figure 1:
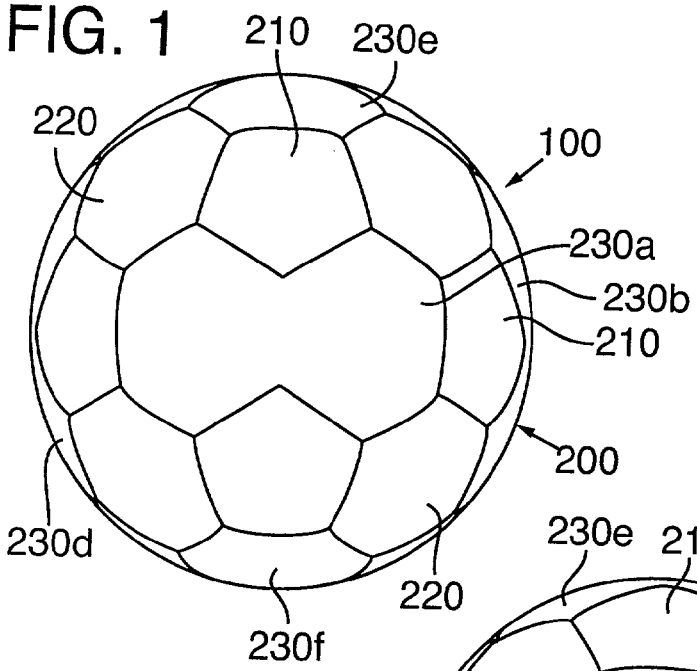
FIG. 1 is a front elevational view of a game ball in accordance with the present invention.

Referring to the drawings, wherein like numerals indicate like elements, a game ball having a structure in accordance with the present invention is disclosed. Although the following discussion is specifically directed to a soccer ball, those of ordinary skill in the relevant art will appreciate that the principles disclosed herein are equally applicable to other types of substantially spherical game balls, including volleyballs for example. FIGS. 1 through 10 depict a soccer ball 100 having a casing 200, a liner 300, and a bladder 400. In general, casing 200 forms an outer layer of ball 100. Liner 300 is positioned between casing 200 and bladder 400, thereby forming an intermediate layer. Bladder 400 then forms an inner layer which also defines the edges of an interior void that typically includes air at greater than atmospheric pressure. Ball 100 also includes a valve 410 that may be integrally-formed with bladder 400, extends through liner 300, and is accessible through an aperture formed in casing 200. Valve 410 is utilized to inject pressurized air into the interior void defined by bladder 400.

Casing 200 includes twelve pentagonal panels 210, eight hexagonal panels 220, and six bridged panels 230 that are connected along abutting edges. The panels may be connected through stitching or an adhesive, for example. Suitable materials for casing 200 include leather and synthetic materials such as polyurethane synthetic leather.

Figure 11:
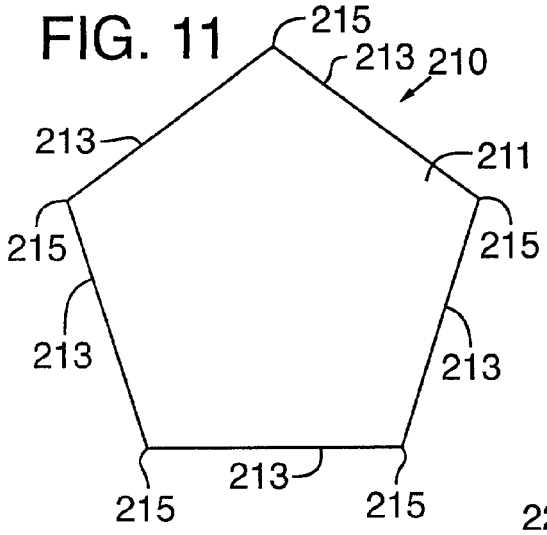
FIG. 11 is a plan view of a pentagonal panel according to the present invention.

Each pentagonal panel 210, depicted in FIG. 11, has the configuration of an equilateral pentagon and includes an exterior surface 211 that faces away from ball 100 and an opposite, identically-shaped interior surface 212 (not shown) that faces the interior of ball 100 and contacts liner 300. As will become apparent from the discussion below, the edges of panels 210, 220, and 230 have either a common long length or a common short length. With respect to pentagonal panel 210, five long edges 213, all having the long length, define the boundaries of exterior surface 211 and interior surface 212. In addition, the ends of long edges 213 abut to form five points 215.

Figure 12:
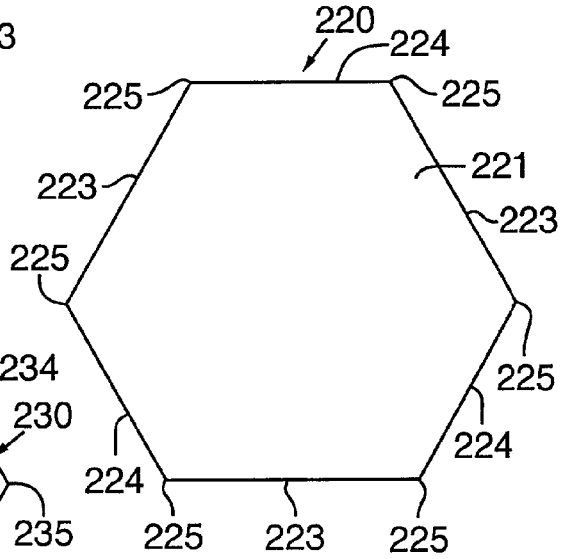
FIG. 12 is a plan view of a hexagonal panel according to the present invention.

Each hexagonal panel 220, depicted in FIG. 12, has the configuration of an equiangular and non-equilateral hexagon and includes an exterior surface 221 and an opposite, identically-shaped interior surface 222 (not shown). Three long edges 223 that alternate with three short edges 224 define the exterior boundaries of each hexagonal panel 220. As previously noted, the long edges 213 of pentagonal panel 210 have the same length as long edges 223 of hexagonal panel 220. Six points 225 are formed by abutting ends of edges 223 and 224. As noted, each hexagonal panel 220 is equiangular and non-equilateral. Within the scope of the present invention, each hexagonal panel may also be non-equiangular.

Figure 13:
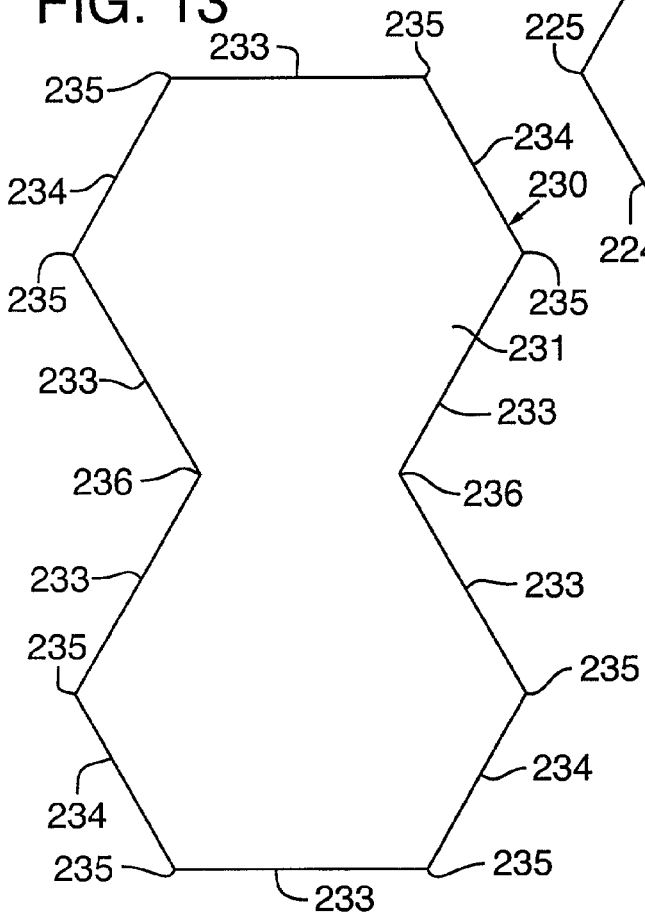
FIG. 13 is a plan view of a bridged panel according to the present invention.

Each bridged panel 230, depicted in FIG. 13, includes two equiangular and non-equilateral hexagonal portions that are integrally-connected along an abutting edge to form a uniform exterior surface 231 and an opposite interior surface 232. More particularly, each bridged panel 230 includes two integrally-connected hexagonal portions that each have the configuration and dimensions of a hexagonal panel 220. If separated from bridged panel 230, each hexagonal portion would include three long edges 233 and three short edges 234. Note, however, that the hexagonal portions are integrally-connected along two short edges 234. Accordingly, each bridged panel includes six exposed long edges 233 and four exposed short edges 234. Eight points 235 are formed by abutting ends of edges 233 and 234. Similarly, two indentations 236 are formed by the abutting ends of edges 234. Each bridged panel may also have a configuration wherein each hexagonal portion is non-equiangular.

Figure 2:
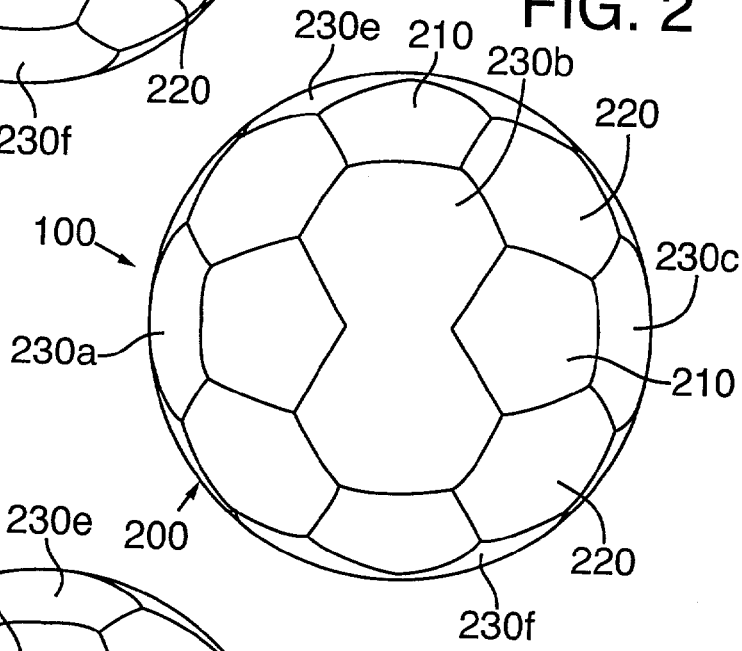
FIG. 2 is a right side elevational view of the game ball in FIG. 1.
Figure 3:
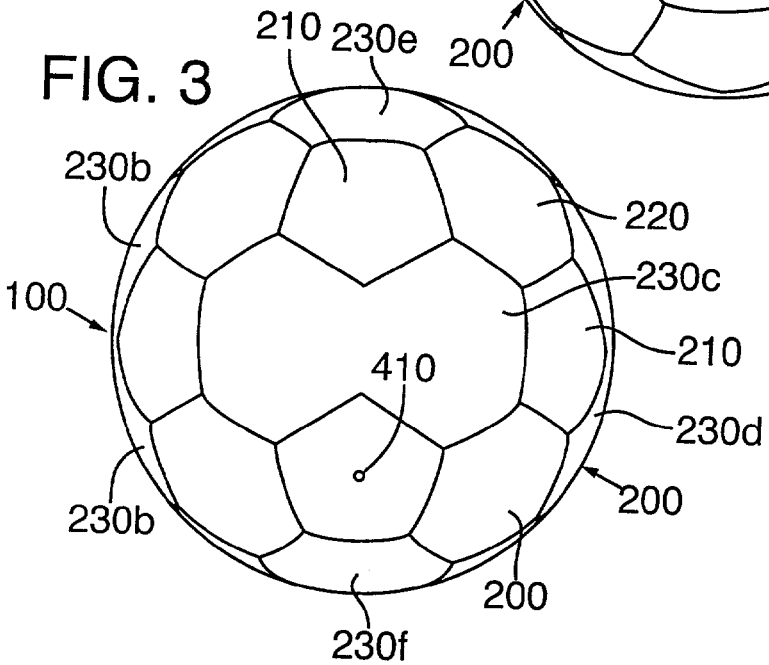
FIG. 3 is a back elevational view of the game ball in FIG. 1.
Figure 4:
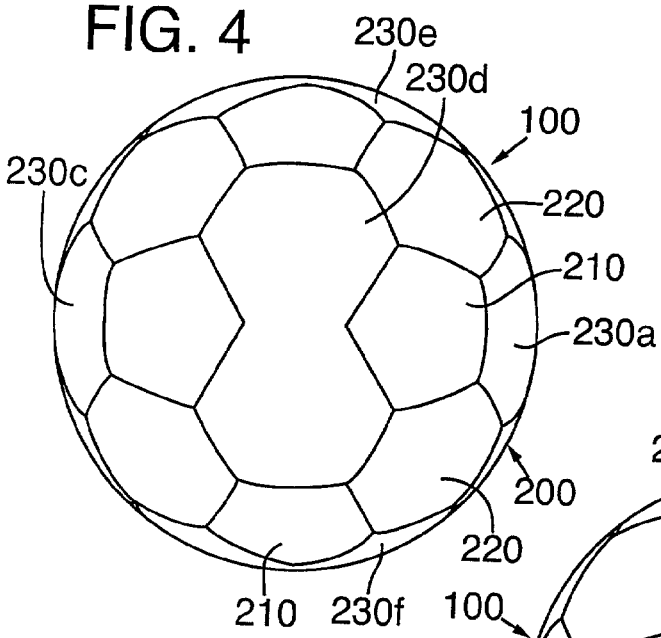
FIG. 4 is a left side elevational view of the game ball in FIG. 1.
Figure 5:
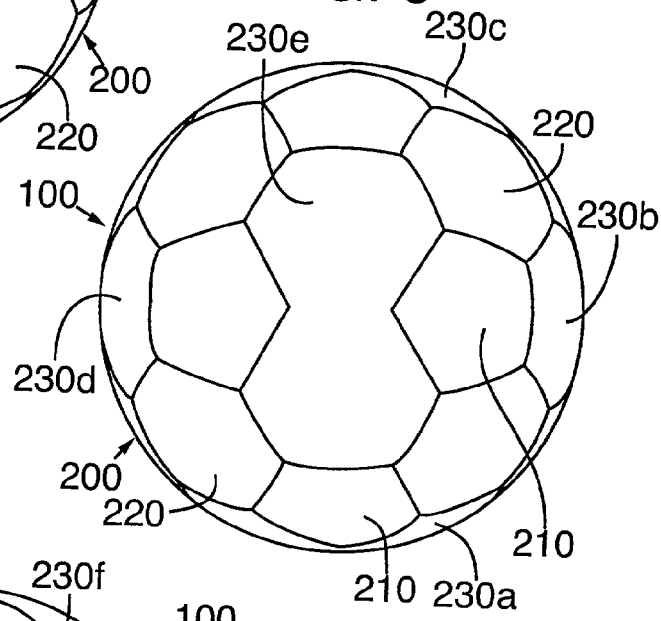
FIG. 5 is a top plan view of the game ball in FIG. 1.
Figure 6:
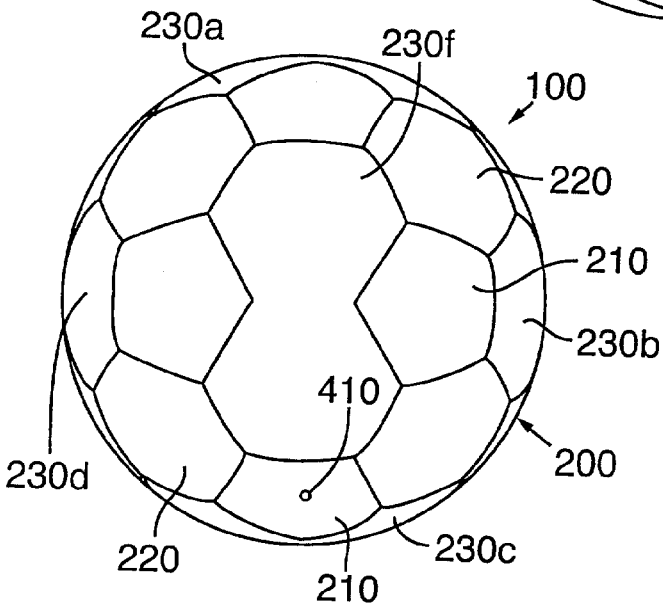
FIG. 6 is a bottom plan view of the game ball in FIG. 1.
Figure 7:
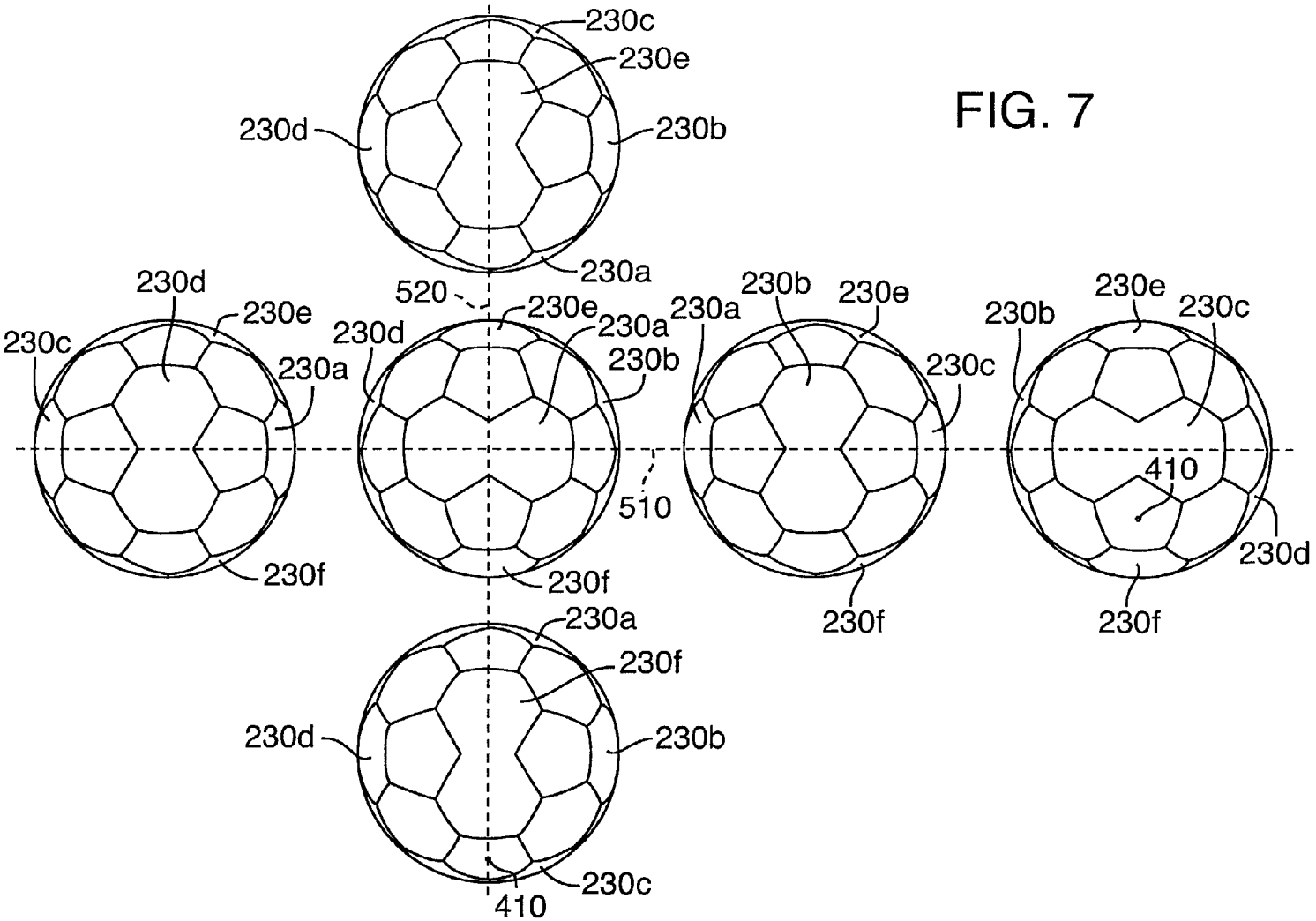
FIG. 7 is a schematic that depicts the relationship between the various views of FIGS. 1–6.
Figure 8:
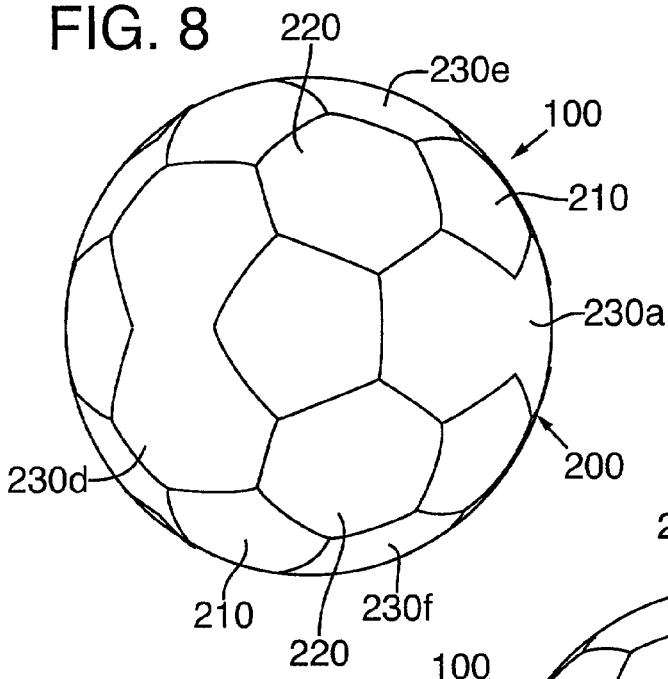
FIG. 8 is a perspective view depicting the front and left sides of the game ball in FIG. 1.
Figure 9:
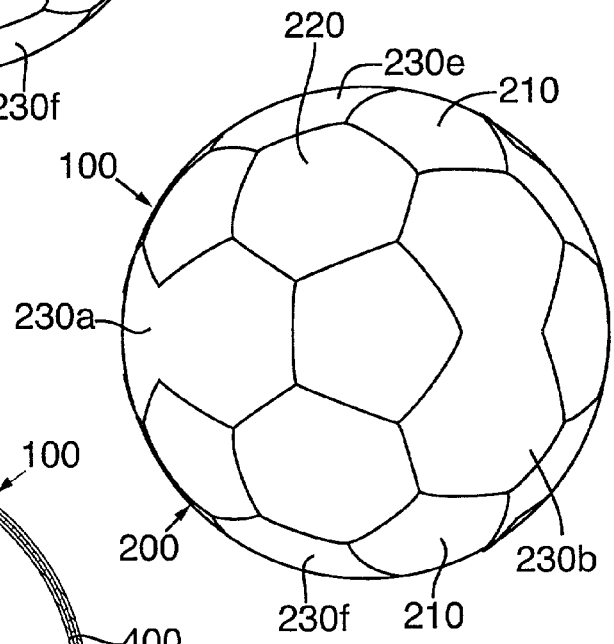
FIG. 9 is a perspective view depicting the front and right sides of the game ball in FIG. 1.
Figure 10:
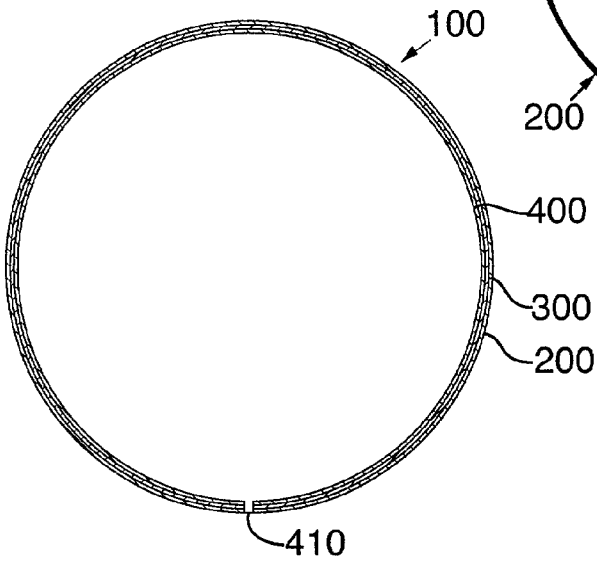
FIG. 10 is a cross-sectional view as defined by line 9—9 in FIG. 8.

Ball 100 has the approximate shape of a sphere. Accordingly, there are no true points of reference on the exterior of ball 100. For purposes of the present discussion, however, the various views of FIGS. 1–6, which define a front, right side, back, left side, top, and bottom, respectively, will be used as points of reference. One skilled in the relevant art will recognize that the designations of front, right side, back, left side, top, and bottom are not intended to limit the scope of the invention. Rather, the designations are intended to provide reference points to assist in the following discussion. To distinguish between the various bridged panels 230 distributed around ball 100, bridged panel 230*a* is located on the front of ball 100, as depicted in FIG. 1; bridged panel 230*b* is located on the right of ball 100, as depicted in FIG. 2; bridged panel 230*c* is located on the back of ball 100, as depicted in FIG. 3; bridged panel 230*d* is located on the left of ball 100, as depicted in FIG. 4; bridged panel 230*e* is located on the top of ball 100, as depicted in FIG. 5; and bridged panel 230*f* is located on the bottom of ball 100, as depicted in FIG. 6. To further assist in comprehending the structure of ball 100, FIG. 7 is a schematic that depicts the relationship between the various views. Additionally, FIGS. 8 and 9 show a first perspective view of the front and left side and a second perspective view of the front and right side, respectively.

Referring to FIG. 7, bridged panels 230 are oriented such that a line 510 that passes longitudinally through bridged panel 230*a* on the front of ball 100 will pass through bridged panel 230*b* between the hexagonal portions. As line 510 continues around ball 100, it will coincide with a longitudinal centerline of bridged panel 230*c* on the back of ball 100 and then continue to the left side and pass between the hexagonal portions of bridged panel 230*d*, thereafter returning to bridged panel 230*a*. Similarly, a line 520 that passes between the hexagonal portions of bridged panel 230*a* will coincide with a longitudinal centerline of bridged panel 230*e* on the top of ball 100, pass between the hexagonal portions of bridged panel 230*c*, and continue on to pass longitudinally through bridged panel 230*f* on the bottom of ball 100.

Pentagonal panels 210 and hexagonal panels 220 are disposed between and around bridged panels 230. With respect to an individual bridged panel 230, four pentagonal panels 210 alternate with four hexagonal panels 220 such that pentagonal panels 210 only abut long edges 233 and hexagonal panels 220 only abut short edges 234. The pentagonal panels 210 are located such that a first pentagonal panel 210 abuts a long edge 233 on one longitudinal end of bridged panel 230; a second pentagonal panel 210 abuts another long edge 233 on the opposite longitudinal end of bridged panel 230; a third pentagonal panel 210 abuts two adjacent long edges 233 that are on either side of one indentation 226; and a fourth pentagonal panel 210 abuts two adjacent long edges 233 that are on either side of an opposite indentation 226. The following are some general concepts concerning the arrangement of pentagonal panels 210: First, every pentagonal panel 210 abuts a first bridged panel 230 in the location of an indentation 236 and abuts a second bridged panel on a longitudinal end. Second, two long edges 213 of every pentagonal panel 210 abut two long edges 223 of two different hexagonal panels 220. Third, no pentagonal panel 210 abuts a different pentagonal panel 210.

Hexagonal panels 220 include both long edges 223 and short edges 224. Hexagonal panels 220, however, only abut short edges 234 of bridged panels 230. Accordingly, four hexagonal panels 220 abut the four short edges 234 that are located on each bridged panel 230. The following are some general concepts concerning the arrangement of hexagonal panels 220: First, the three long edges 223 of every hexagonal panel 220 abuts three different pentagonal panels 210. Second, the three short edges 224 of every hexagonal panel 220 abuts three different bridged panels 230.

The traditional soccer ball, which is discussed in the section entitled Description of Background Art, includes 12 pentagonal panels with the shape of equilateral pentagons and 20 hexagonal panels with the shape of equilateral hexagons. In locations where the panels abut, the traditional soccer ball includes seams where the panels are stitched together. The presence of seams detracts from the spherical shape of the ball. Furthermore, portions of a soccer ball with a seam are more rigid than the portions corresponding with the panels. This may contribute to disparities in how the soccer ball reacts following a kick or bounce, depending upon whether the kick or bounce occurred on a seam or on other portions of the soccer ball. Ball 100 includes six bridged panels 230. Ball 100 includes, therefore, six fewer seams than the traditional soccer ball, thereby increasing the spherical properties of ball 100 and reducing the number of rigid areas on the surface of ball 100. An increase in the spherical properties has a positive effect upon the performance of ball 100 by increasing the uniformity in casing panel stresses and reducing drag in flight. In addition, fewer soccer balls 100 will be rejected during the manufacturing process because they do not meet specific tolerances regarding roundness, weight, and center of gravity.

Due to the geometrical properties of traditional soccer balls, the seams between hexagonal panels may represent areas of low durability. Ball 100, however, increases the durability of seams by altering the geometry of the panels. Ball 100 includes non-equilateral hexagonal panels 220 with long edges 223 and short edges 224 rather than equilateral hexagonal panels. In the traditional soccer ball, the seams between two adjacent hexagonal panels bear higher stresses than the seams between hexagonal panels and pentagonal panels. By decreasing the length of the seams between hexagonally-shaped portions of ball 100 and bridged panels, specifically hexagonal panels 220 and the hexagonal portions of bridged panels 230, the stress in these seams is reduced. More specifically, changes in the geometry of hexagonal panels 220 and the hexagonal portions of bridged panels 230 results in substantially equal values of material stress and degree of stretch in pentagonal panels 210, hexagonal panels 220, and bridged panels 230. In order to accomplish substantially equal values of material stress the ratio between the lengths of short edges 224 and 234 to long edges 213, 223, and 233 is 0.839. Reductions in the values of material stress may be accomplished, however, with a ratio that is between approximately 0.69 and 0.99.

In addition to the panels that form casing 200, ball 100 includes a liner 300 and a bladder 400. Liner 300 is positioned between casing 200 and bladder 400 and serves the purpose of a support material that provides structural integrity and shape retention. Suitable materials for liner 300 include a woven cloth formed of cotton, polyviscose, polyester, or a combination thereof. Two to four layers of the cloth, for example, may be laminated with a latex-based adhesive to form liner 300. Bladder 400 may be inflated with air to a desired pressure through valve 410 in order to place a uniform, outward pressure on liner 300 and casing 200 that induces the substantially spherical shape of ball 100. Suitable materials for bladder 400 include butyl rubber, latex rubber, or polyurethane.

The present invention is disclosed above and in the accompanying drawings with reference to a preferred embodiment. The purpose served by disclosure of the preferred embodiment, however, is to provide an example of the various aspects embodied in the invention, not to limit the scope of the invention. One skilled in the art will recognize that numerous variations and modifications may be made to the preferred embodiments without departing from the scope of the present invention, as defined by the appended claims.

The invention claimed is:

1. A game ball including a plurality of panels connected along abutting edges, said plurality of panels comprising a bridged panel, a hexagonal panel, and a pentagonal panel, said bridged panel being formed of two seamlessly-joined, non-equilateral, hexagonal portions, said bridged panel defining a plurality of edges, each said edge having a length selected from a short length and a long length, a ratio of said short length to said long length being selected to provide substantially equal values of material stress and degree of stretch in said plurality of panels.

2. The game ball of claim 1, wherein said plurality of panels are joined to collectively form a substantially spherical shape.

3. The game ball of claim 1, wherein said game ball is a soccer ball.

4. The game ball of claim 1, wherein said ratio of said short length to said long length is at least 0.69.

5. The game ball of claim 1, wherein said ratio of said short length to said long length is approximately 0.839.

6. The game ball of claim 1, wherein one said edge with said short length from a first of said hexagonal portions is integrally-formed with one said edge with said short length from a second of said hexagonal portions.

7. The game ball of claim 1, wherein said plurality of panels include six of said bridged panel.

8. The game ball of claim 7, wherein said plurality of panels include twelve of said pentagonal panel and eight of said hexagonal panel.

9. The game ball of claim 8, wherein said pentagonal panels are equilateral, and said hexagonal panels are non-equilateral.

10. The game ball of claim 8, each said bridged panel is bounded by four of said hexagonal panels and four of said pentagonal panels.

11. The game ball of claim 8, wherein each said pentagonal panel includes five edges having said long length, and each said hexagonal panel includes three edges having said long length and three edges having said short length.

12. A game ball that includes a plurality of panels connected along abutting edges, said plurality of panels comprising six bridged panels, eight hexagonal panels, and twelve pentagonal panels, each said bridged panel including a first hexagonal portion that is seamlessly-joined with a second hexagonal portion, said plurality of panels each having a plurality of edges with a length selected from a short length and a long length, a ratio of said short length to said long length being in a range of 0.69 to 0.99.

13. The game ball of claim 12, wherein said game ball is a soccer ball.

14. The game ball of claim 12, wherein said bridged panels abut only said pentagonal panels and said hexagonal panels.

15. The game ball of claim 12, wherein four of said hexagonal panels and four of said pentagonal panels are positioned in an alternating configuration around each said bridged panel.

16. The game ball of claim 12, wherein said pentagonal panels are equilateral, and said hexagonal panels are non-equilateral.

17. The game ball of claim 12, wherein each said pentagonal panel includes five said edges having said long length, and each said hexagonal panel includes three said edges having said long length and three said edges having said short length.

18. The game ball of claim 12, wherein said ratio of said short length to said long length is approximately 0.839.

19. The game ball of claim 12, wherein one said edge with said short length from said first hexagonal portion is integrally-formed with one said edge with said short length from said second hexagonal portion.

20. A substantially spherical soccer ball that includes a plurality of panels connected along abutting edges, said plurality of panels comprising six bridged panels, eight non-equilateral hexagonal panels, and twelve equilateral pentagonal panels, each said bridged panel including a first hexagonal portion that is seamlessly-joined with a second hexagonal portion, said plurality of panels each having a plurality of edges with a length selected from a short length and a long length, a ratio of said short length to said long length being approximately 0.839 to provide substantially equal values of material stress and degree of stretch in said panels.

21. The game ball of claim 20, wherein each said equilateral pentagonal panel includes five said edges having said long length, and each said non-equilateral hexagonal panel includes three said edges having said long length and three said edges having said short length.

22. The game ball of claim 20, wherein one said edge with a short length from said first hexagonal portion is integrally-formed with one said edge with a short length from said second hexagonal portion.

23. A substantially spherical game ball including a plurality of panels connected along abutting edges, said plurality of panels comprising:

a bridged panel including a first hexagonal portion and a second hexagonal portion, each said hexagonal portion having a non-equilateral configuration, and each said hexagonal portion defining six edges, three of said edges of each said hexagonal portion having a long length, and three of said edges of each said hexagonal portion having a short length, said first hexagonal portion being seamlessly-joined with said second hexagonal portion;

a hexagonal panel with a non-equilateral configuration, said hexagonal panel defining six edges, at least one of said edges of said hexagonal panel having said long length and at least one of said edges of said hexagonal panel having said short length; and a pentagonal panel with an equilateral configuration, said pentagonal panel defining five edges, each said edge of said pentagonal panel having said long length, said long length and said short length being selected to provide substantially equal values of material stress and degree of stretch in said panels.

24. The game ball of claim 23, wherein said game ball is a soccer ball.

25. The game bail of claim 23, wherein a ratio of said short length to said long length is at least 0.69.

26. The game ball of claim 23, wherein a ratio of said short length to said long length is approximately 0.839.

27. The game ball of claim 23, wherein one of said edges of said first hexagonal portion with said short length is joined with one of said edges of said second hexagonal portion with said short length to integrally-form said first hexagonal portion with said second hexagonal portion.

28. A substantially spherical soccer ball including a plurality of panels connected along abutting edges, said plurality of panels comprising:

six bridged panels that each include a first hexagonal portion and a second hexagonal portion, each said hexagonal portion having a non-equilateral configuration, and each said hexagonal portion defining six edges, three of said edges of each said hexagonal portion having a long length, and three of said edges of each said hexagonal portion having a short length, one of said edges of said first hexagonal portion with said short length being joined with one of said edges of said second hexagonal portion with said short length to seamlessly-join said first hexagonal portion with said second hexagonal portion;

eight hexagonal panels with a non-equilateral configuration, each said hexagonal panel defining six edges, at least one of said edges of said hexagonal panel having said long length and at least one of said edges of said hexagonal panel having said short length; and twelve pentagonal panels with an equilateral configuration, each said pentagonal panel defining five edges, each said edge of said pentagonal panel having said long length, a ratio of said long length to said short length being in a range of 0.69 to 0.99.

29. The game ball of claim 28, wherein said bridged panels abut only said pentagonal panels and said hexagonal panels.

30. The game ball of claim 28, wherein said bridged panels are bounded by alternating said pentagonal panels and said hexagonal panels such that each of said bridged panels abut and are connected to four of said pentagonal panels and four of said hexagonal panels.

31. The game ball of claim 28, wherein each said pentagonal panel includes five said edges having said long length, and each said hexagonal panel includes three said edges having said long length and three said edges having said short length.

32. The game ball of claim 28, wherein said ratio of said short length to said long length is approximately 0.839.

33. A substantially spherical soccer ball including a plurality of panels connected along abutting edges, said plurality of panels comprising:

six bridged panels that each include a first hexagonal portion and a second hexagonal portion, each said hexagonal portion having a non-equilateral configuration, and each said hexagonal portion defining six edges, three of said edges of each said hexagonal portion having a long length, and three of said edges of each said hexagonal portion having a short length, one of said edges of said first hexagonal portion with said short length being joined with one of said edges of said second hexagonal portion with said short length to seamlessly-join said first hexagonal portion with said second hexagonal portion;

eight hexagonal panels with a non-equilateral configuration, each said hexagonal panel defining six edges, at least one of said edges of said hexagonal panel having said long length and at least one of said edges of said hexagonal panel having said short length; and twelve pentagonal panels with an equilateral configuration, each said pentagonal panel defining five edges, each said edge of said pentagonal panel having said long length, a ratio of said long length to said short length being approximately 0.839 to provide substantially equal values of material stress and degree of stretch in said panels.

34. The game ball of claim 33, wherein said bridged panels abut only said pentagonal panels and said hexagonal panels.

35. The game ball of claim 33, wherein said bridged panels are bounded by alternating said pentagonal panels and said hexagonal panels such that each of said bridged panels abut and are connected to four of said pentagonal panels and four of said hexagonal panels.

* * * * *